US006692078B2

(12) United States Patent
Pham et al.

(10) Patent No.: US 6,692,078 B2
(45) Date of Patent: Feb. 17, 2004

(54) LOW PROFILE ARTICULATED FOOTREST ASSEMBLY AND ROCKING ARMCHAIR USING SAME

(75) Inventors: Viet Pham, Ville St-Laurent (CA); Philippe April, St-Eustache (CA); Patrice Pelletier, 70, rue des Pruches, Ste-Mélanie, Quebec (CA), J0K 3A0

(73) Assignees: Patrice Pelletier, Ste-Mélanie (CA); Gino Pelletier, Ste-Mélanie (CA)

( * ) Notice: Subject to any disclaimer, the term of this patent is extended or adjusted under 35 U.S.C. 154(b) by 0 days.

(21) Appl. No.: 10/265,880

(22) Filed: Oct. 8, 2002

(65) Prior Publication Data

US 2003/0075965 A1 Apr. 24, 2003

(30) Foreign Application Priority Data

Oct. 12, 2001 (CA) ..... 2359985

(51) Int. Cl.[7] ..... A47C 20/00

(52) U.S. Cl. ..... 297/423.2; 297/423.19; 297/76

(58) Field of Search ..... 297/423.19, 423.2, 297/423.26, 423.35, 69, 85, 75, 76

(56) References Cited

U.S. PATENT DOCUMENTS

| | | | | |
|---|---|---|---|---|
| 2,480,300 A | * | 8/1949 | Luketa | 297/423.2 |
| 4,364,603 A | | 12/1982 | Johnson | |
| 4,506,925 A | | 3/1985 | Crum | |
| 4,669,778 A | | 6/1987 | Rogers, Jr. | |
| 4,696,512 A | | 9/1987 | Burnett et al. | |
| 4,945,582 A | * | 8/1990 | Hayton et al. | 5/610 |
| 5,507,562 A | | 4/1996 | Wieland | |
| 5,556,157 A | * | 9/1996 | Wempe | 297/68 |
| 5,673,967 A | | 10/1997 | Wempe | |
| 5,782,535 A | | 7/1998 | Lafer | |
| 6,022,071 A | | 2/2000 | Smith | |
| 6,030,033 A | | 2/2000 | Schultz | |
| 6,059,367 A | | 5/2000 | Rogers | |
| 6,095,610 A | * | 8/2000 | Okajima et al. | 297/423.36 |
| 6,129,415 A | * | 10/2000 | Galloway | 297/68 |
| 6,572,185 B1 | * | 6/2003 | Tseng | 297/85 |
| 6,604,791 B1 | * | 8/2003 | Chen | 297/330 |

FOREIGN PATENT DOCUMENTS

JP 11253270 A 9/1999

* cited by examiner

*Primary Examiner*—Peter M. Cuomo
*Assistant Examiner*—Stephen D'Adamo
(74) *Attorney, Agent, or Firm*—Brouillette Kosie Prince

(57) ABSTRACT

An articulated footrest assembly for a seating unit comprises a footrest member moveable between a retracted position and an extended position, a telescopic linkage for extending and retracting the footrest member between the retracted and extended positions, and an actuating linkage. The footrest member comprises proximal and distal portions while the telescopic linkage comprises a stationary support member mounted to the seating unit, a first telescoping arm, and a second telescoping arm. The first telescoping arm has a distal end connected to the proximal portion of the footrest member through a first pivot. The second telescoping arm has a distal end connected to the footrest member between the proximal and distal portions through a second pivot spaced apart from the first pivot. The actuating linkage comprises a first linkage portion interposed between the stationary support member and the first telescoping arm and a second linkage portion interposed between the first and second telescoping arms. When the actuating linkage is operated, the first linkage portion moves the first telescoping arm in one of forward and rearward directions relative to the stationary support member and the second linkage portion moves the second telescoping arm in the same direction relative to the first telescoping arm thereby simultaneously moving the footrest member in that direction and pivoting the footrest member about the first and second pivots.

13 Claims, 9 Drawing Sheets

LOW PROFILE ARTICULATED FOOTREST ASSEMBLY AND ROCKING ARMCHAIR USING SAME

FIELD OF THE INVENTION

The present invention relates to an articulated footrest assembly and a rocking chair using this footrest assembly.

In particular but not exclusively, the subject invention is concerned with a footrest assembly suitable for installation on a broad range of seating units, in particular but not exclusively when limited clearance is available for installing the footrest assembly.

BACKGROUND OF THE INVENTION

A variety of reclining armchairs with a retractable footrest mechanism has been proposed to improve the comfort of the occupant. Typically, the footrest extending/retracting mechanism is coupled to the backrest reclining system of a recliner armchair. As a consequence, the occupant is not allowed to benefit from the optimal comfort of the footrest since the footrest mechanism is only fully extended at the fully reclined position of the backrest.

Furthermore, in most of the cases, the footrest extension mechanism does not project the footrest plate far forward from the seat, as a linear actuator could do for instance. Therefore, a large footrest plate must be used which, in its retracted position, projects downwards and generally perpendicular to the armchair seat. This closes most of the space between the seat level and the floor at the front of the armchair and prevents the use of the space for storage and hindering free movement of an occupant's feet.

These footrest mechanisms also generally use a high profile vertical pantograph mechanism to provide the retraction/extension movement of the footrest. Such mechanisms require a large cavity of free space extending deeply beneath a seat frame and behind the front end thereof, and are therefore unsuited for use on a seating unit with restricted unobstructed space availability under the seat, as is the case with many types of rocking armchairs in which cross-members leave a vertical clearance of only a few inches below the seat frame.

A number of alternative devices have been developed to overcome some of the shortcomings and limitations of the above described footrest mechanisms.

For instance, U.S. Pat. No. 4,696,512 issued to Burnett et al. on Sep. 29, 1987 discloses a low profile motor driven screw/drive tube mechanism actuating the backrest and footrest of a recliner chair. Although a relatively low profile of the actuating system is provided by the screw mechanism and enables some space saving, such a mechanism needs an electrically powered motor which is expensive and not practical for most chair applications. Furthermore, the drive system projects far behind the back of the seat frame and actuation of the footrest extension is coupled to the backrest reclining actuation mechanism.

Japanese application JP11253270A, filed by Wada and published on Sep. 21, 1999 discloses a substantially horizontal moving-forward/backward footrest mechanism. This system features a relatively low profile and the extension sliding means allows a small footrest panel to project forwardly from the seat and provide adequate support for the occupant's legs. Therefore, only a small vertical clearance under the seat frame is required to house the system and enable the footrest panel to retract in its vertical position.

Storage space could also be provided under the seat. However, that system also relies on a screw/tube drive mechanism, needing to be either motor or crank powered, which constitutes a major drawback for many potential applications, namely in usual rocking chairs.

A footrest system adapted to a rocking chair is disclosed by U.S. Pat. No. 6,059,367 granted to Rodgers on May 9, 2000. However, the mechanism connecting the footrest plate to the chair uses a vertical pantograph linkage and requires a cavity of at least eight inches high under the seat assembly in its fully retracted position. It is also worth mentioning that the disclosed rocking seating unit does not provide full control of the gliding motion stability during extension of the footrest, such that the occupant may experience uncomfortable feelings and safety may be compromised.

A footrest mechanism comprising a portion linearly projected forwards from an armchair seat through a horizontal pantograph-type linkage is disclosed in U.S. Pat. No. 5,782,535 issued to Lafer on Jul. 21, 1998. Nevertheless, the linearly displaceable flat frame portion is mounted on a main portion of the footrest mechanism articulated with the front end of the support frame of the seat and displaceable from a non-operative position, inferior and adjacent to the support frame, to an operative position projecting forwards from the seat. The extension and retraction of the footrest is accomplished by operating a short lever. Although the main portion of the footrest can be made shorter because of the addition of a linearly actuated portion, the angular displacement of the main portion still requires a free space underneath the seat of height and a depth at least equal to the length of the displaceable footrest portion. Accordingly, such a system could not be adapted to a seating unit having small vertical clearance or a narrow cavity under the seat, or would prevent the use of a major part of any available space for storage.

Although a variety of different footrest mechanisms adapted to seating units have been developed, these mechanisms nevertheless lack important features hindering their use as readily installable low profile modular units for providing a wide range of seating units with a compact, simple, efficient and safe footrest system. Also, no practical solution has been designed to properly fit and use an articulated footrest system in conjunction with a rocking, swivel or reclining chair having only a few inches of vertical clearance under the seat.

SUMMARY OF THE INVENTION

In accordance with the present invention, there is provided an articulated footrest assembly for a seating unit, comprising:

- a footrest member moveable between a retracted position and an extended position, and comprising proximal and distal portions;
- a telescopic linkage for extending and retracting the footrest member between the retracted and extended positions, the telescopic linkage comprising a stationary support member mounted to the seating unit, a first telescoping arm, and a second telescoping arm, wherein the first telescoping arm has a distal end connected to the proximal portion of the footrest member through a first pivot, and wherein the second telescoping arm has a distal end connected to the footrest member between the proximal and distal portions through a second pivot spaced apart from the first pivot; and
- an actuating linkage comprising a first linkage portion interposed between the stationary support member and the first telescoping arm and a second linkage portion interposed between the first and second telescoping arms wherein, when the actuating linkage is operated, the first linkage portion moves the first telescoping arm in one of forward and rearward directions relative to the stationary support member and the second linkage portion moves the second telescoping arm in said one direction relative to the first telescoping arm thereby simultaneously moving the footrest member in said one direction and pivoting the footrest member about the first and second pivots.

The present invention also relates to a reclining rocking chair comprising:

a floor supported chassis carrying a seat support frame having a free space thereunder and a backrest;

an articulated footrest assembly, including:

a footrest member moveable between a retracted position and an extended position, and comprising proximal and distal portions;

a telescopic linkage for extending and retracting the footrest member between the retracted and extended positions, the telescopic linkage comprising a stationary support member mounted to the seat support frame, a first telescoping arm, and a second telescoping arm, wherein the first telescoping arm has a distal end connected to the proximal portion of the footrest member through a first pivot, and wherein the second telescoping arm has a distal end connected to the footrest member between the proximal and distal portions through a second pivot spaced apart from the first pivot; and an actuating linkage comprising a first linkage portion interposed between the stationary support member and the first telescoping arm and a second linkage portion interposed between the first and second telescoping arms wherein, when the actuating linkage is operated, the first linkage portion moves the first telescoping arm in one of forward and rearward directions relative to the stationary support member and the second linkage portion moves the second telescoping arm in said one direction relative to the first telescoping arm thereby simultaneously moving the footrest member in said one direction and pivoting the footrest member about the first and second pivots.

a reclining backrest pivotally mounted to the seat support frame.

The foregoing and other objects, advantages and features of the present invention will become more apparent upon reading of the following non restrictive description of an illustrative embodiment thereof, given by way of example only with reference to the accompanying drawings.

BRIEF DESCRIPTION OF THE DRAWINGS

In the appended drawings:

FIG. 6 is rear, bottom perspective view, partially cross sectional, of the articulated footrest assembly of FIGS. 1–5, in the extended position;

DETAILED DESCRIPTION OF THE ILLUSTRATIVE EMBODIMENT

An illustrative embodiment of the articulated footrest assembly and chair according to the present invention will now be disclosed.

Figure 1:
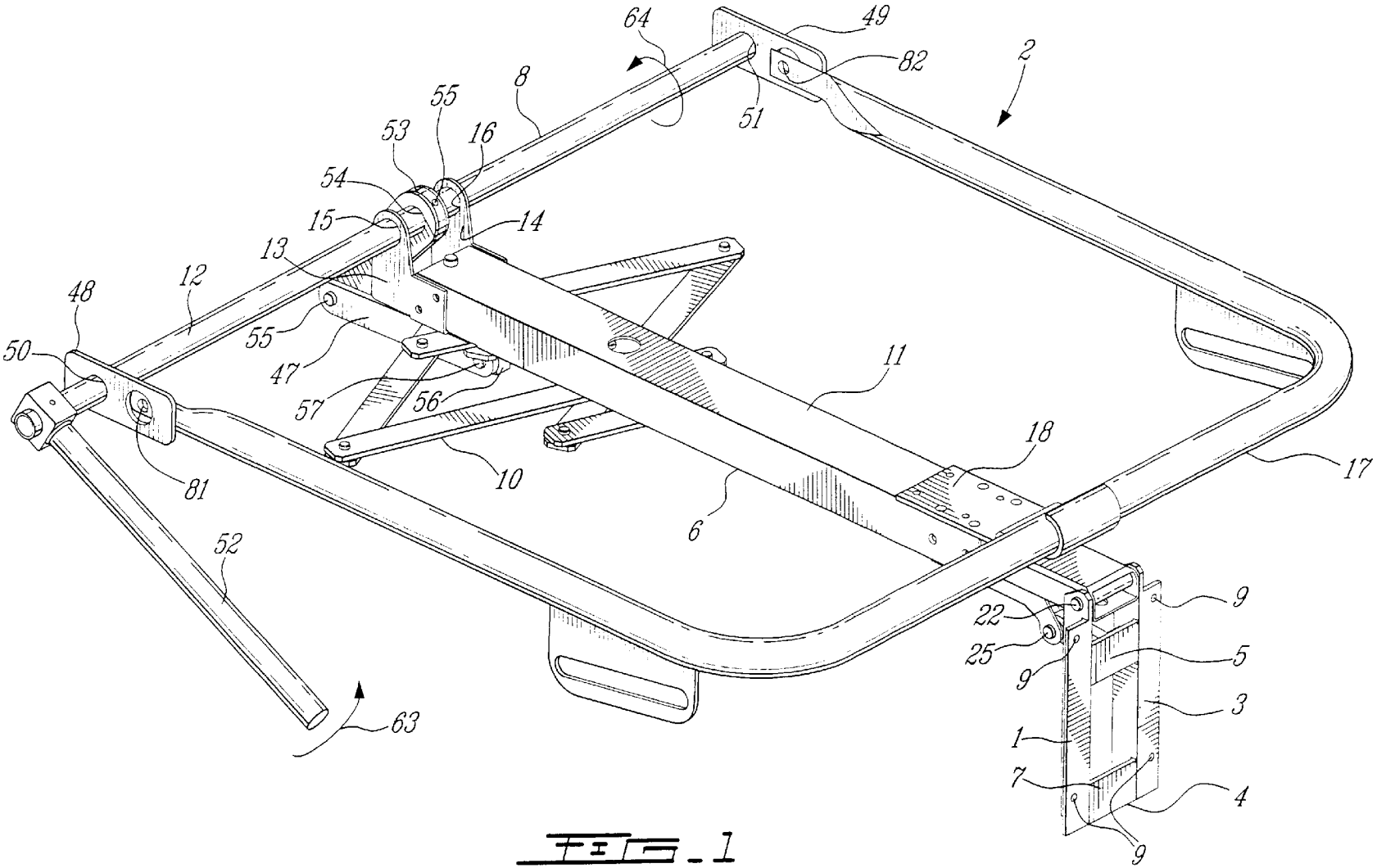
FIG. 1 is a front, top perspective view of the illustrative embodiment of articulated footrest assembly according to the present invention, in the retracted position.

FIG. 1 illustrates a low profile articulated footrest assembly generally identified by the reference 2. Assembly 2 can advantageously be made of metal such as steel and/or aluminium. Of course, the use of any other suitable material can be considered.

Assembly 2 comprises a retractable footrest member 4, a telescopic linkage 6, an actuator mechanism 8 and an actuating linkage 10 interposed between the actuator mechanism 8 and the telescopic linkage 6.

Still referring to FIG. 1, the footrest assembly 2 is shown in its retracted position with the footrest member 4 projecting downwardly. In the illustrative embodiment, the footrest member 4 comprises a pair of parallel angle bars 1 and 3 interconnected through a pair of bars 5 and 7. Holes such as 9 are provided in the angle bars 1 and 3 for mounting and supporting, for example, a cushioned footrest plate (not shown).

Figure 3:
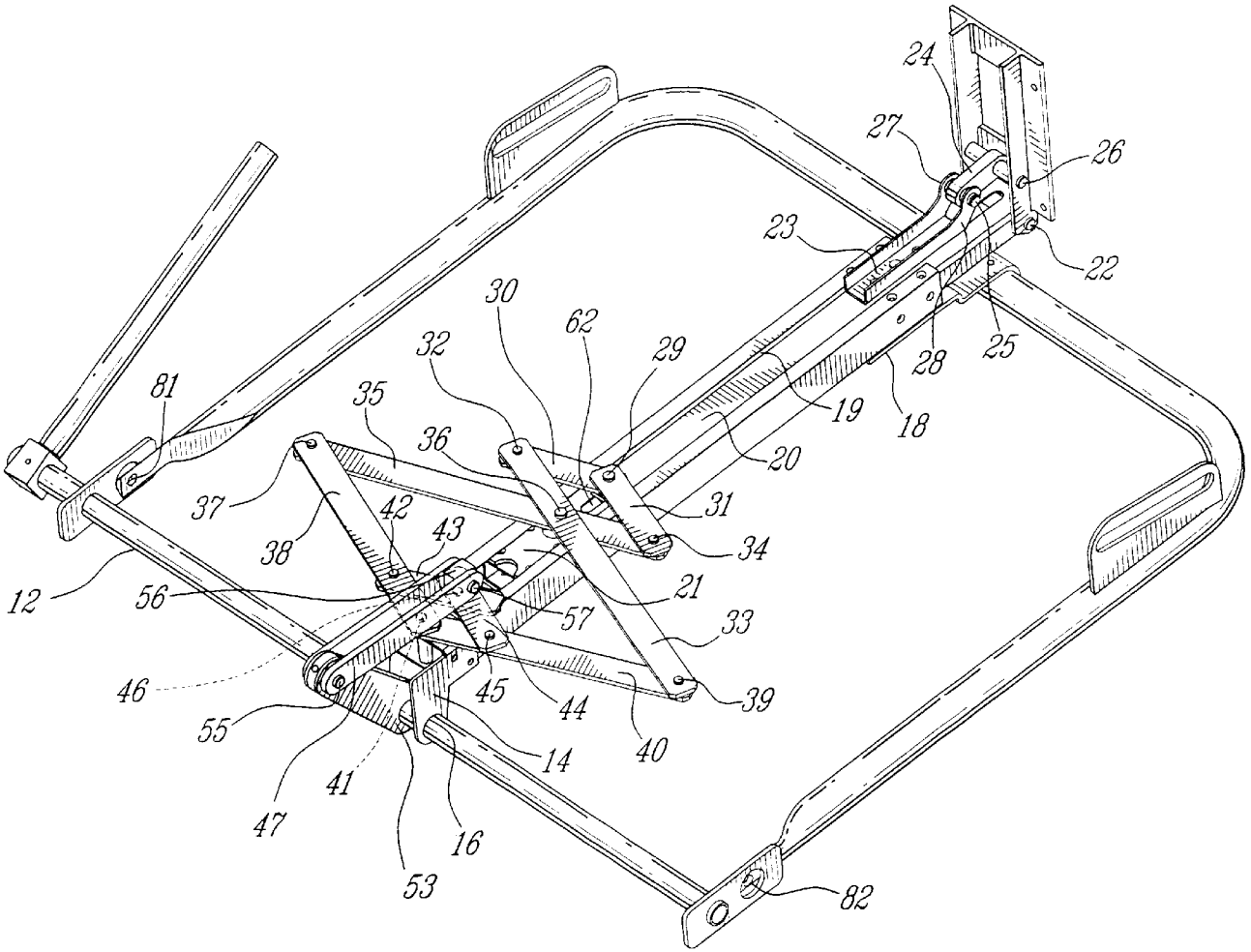
FIG. 3 is rear, bottom perspective view of the articulated footrest assembly of FIGS. 1 and 2, in the retracted position.
Figure 4:
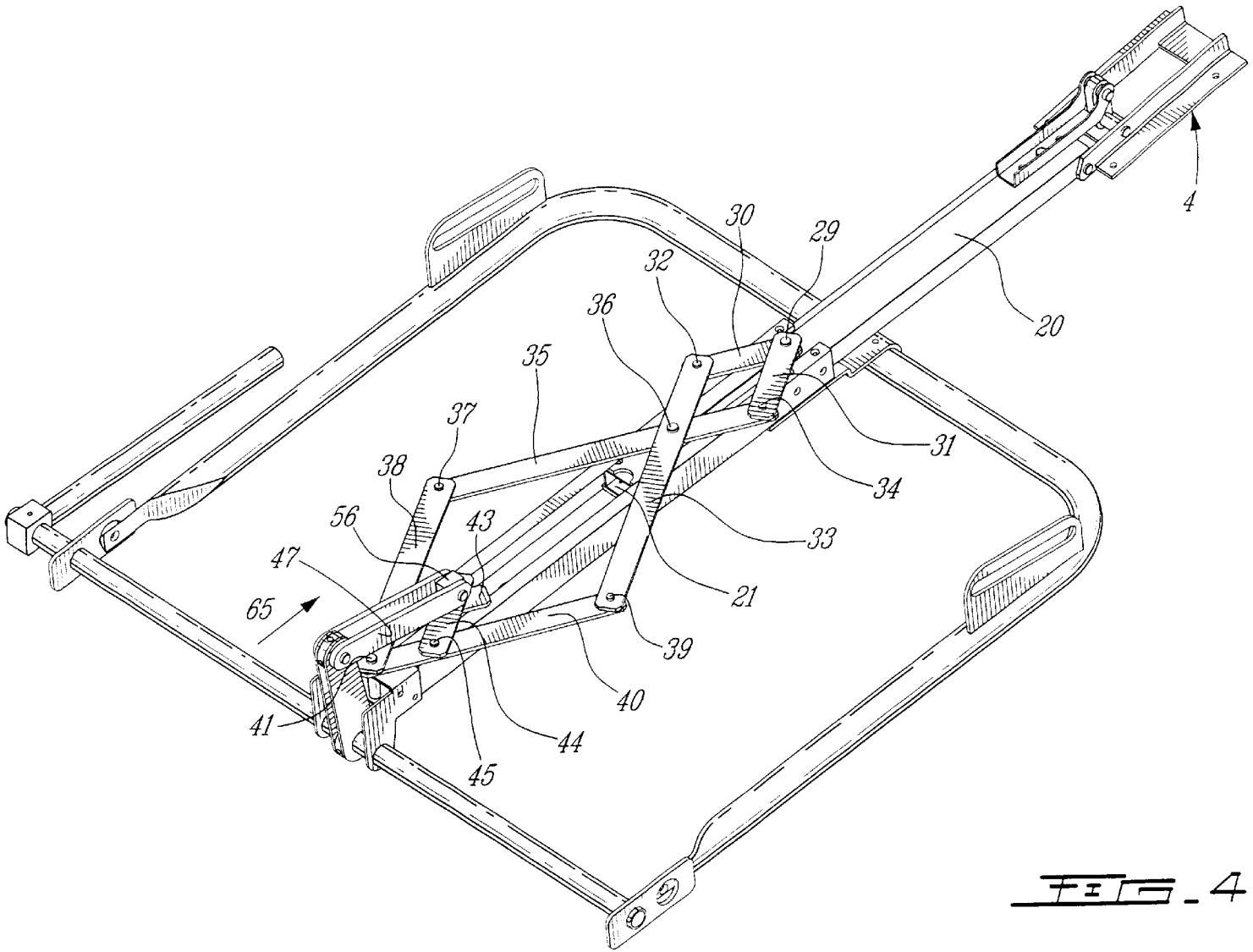
FIG. 4 is rear, bottom perspective view of the articulated footrest assembly of FIGS. 1–3, in the extended position.

The telescopic linkage 6 comprises, according to the illustrative embodiment, a tube 11 of rectangular cross section. As illustrated in FIG. 3, the tube 11 comprises an underside longitudinal slot 19. A rear end of tube 11 is mounted on a rod 12 of the actuator mechanism 8 through a pair of L-shaped brackets 13 and 14. The brackets 13 and 14 are mounted on opposite side faces of the rectangular tube 11 and comprise respective holes 15 and 16 in which the rod 12 is rotatably mounted. The front end of the tube 11 is secured to a seat support frame 17 through a flat bracket 18.

Referring now to both FIGS. 1 and 3, the telescopic linkage 6 further comprises first and second telescoping tubes 20 and 21, both rectangular in cross section. Telescoping tube 20 is free to slide longitudinally in tube 11 while telescoping tube 21 is free to slide longitudinally in tube 20.

The forward end of the innermost tube 21 extends between angle bars 1 and 3 and is pivotally mounted to a proximal end of these angle bars 1 and 3 through a horizontal and transversal pivot 22.

The forward end of the intermediate tube 20 is also pivotally mounted to the angle bars 1 and 3 through a bracket 23 and a bar 24 (FIG. 3). Bracket 23 is secured to the underside of intermediate tube 20. The forward end of bracket 23 is formed with two ears 27 and 28. The proximal end of the bar 24 extends between the two ears 27 and 28 and is pivotally mounted thereto through a horizontal and transversal pivot 25. Finally, the distal end of the bar 24 extends between the angle bars 1 and 3 and is also pivotally connected to the angle bars 1 and 3 through a horizontal and transversal pivot 26. As shown in FIG. 3, pivot 26 is located relatively close to pivot 22 between the pivot 22 and the distal end of the footrest member 4.

Figure 5:
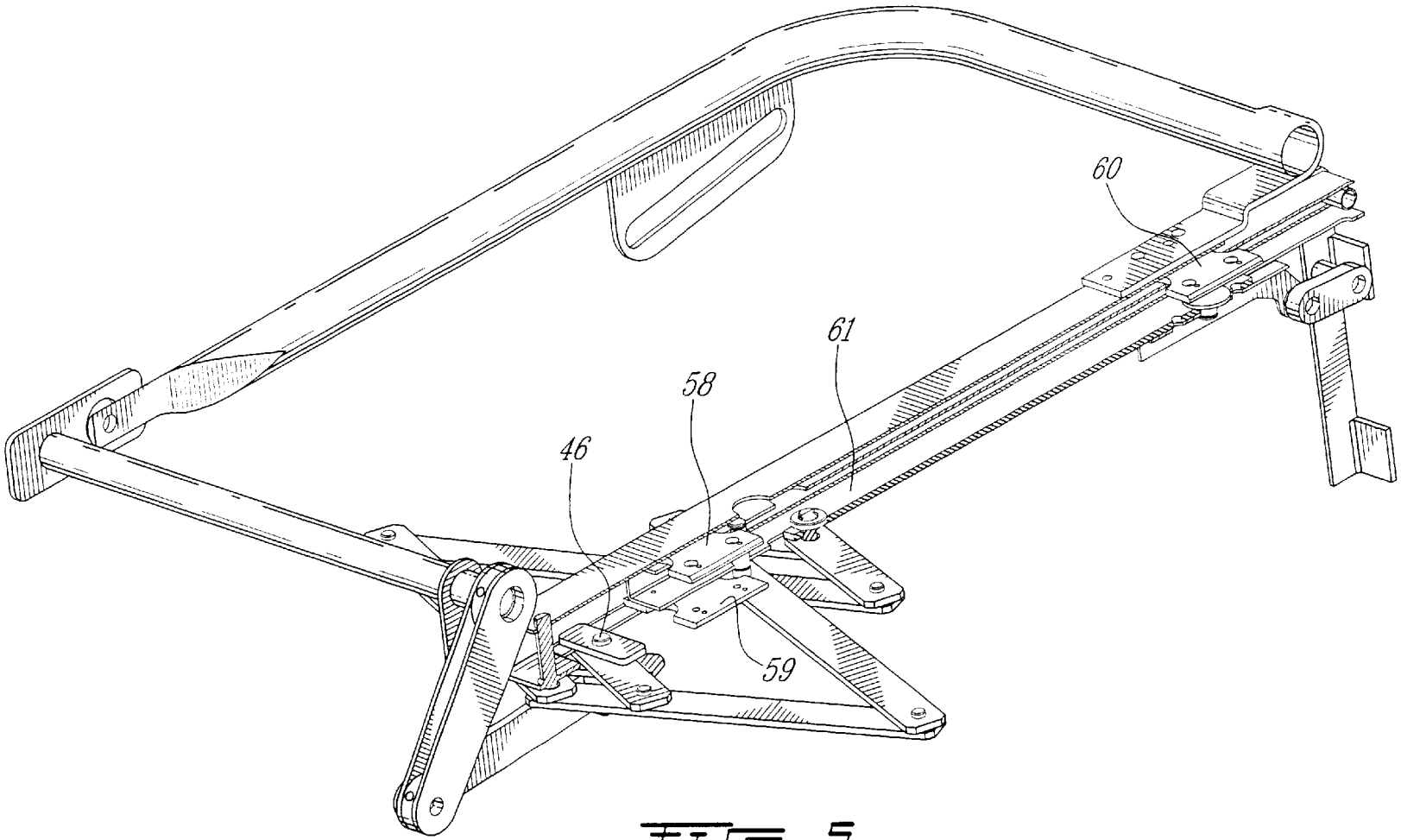
FIG. 5 is rear, bottom perspective view, partially cross sectional, of the articulated footrest assembly of FIGS. 1–4, in the retracted position.

Still referring to FIG. 3, in the illustrative embodiment the actuating linkage 10 comprises a series of flat, pivotally interconnected link members arranged as a pantograph linkage assembly. The pantograph linkage assembly is symmetrical about a vertical plane centered on the tubes 11, 20 and 21. This pantograph linkage assembly comprises:

- a pivot 29 pivotally interconnecting a first end of link member 30, a first end of link member 31, and the rear end of intermediate telescoping tube 20. Referring to FIGS. 5 and 6, it can be observed that the pivot 29 extends through an axial slot 62 (FIG. 3) and comprises a large head 61 located inside tube 20 to limit vertical displacement of this pivot 29;
- a pivot 32 pivotally interconnecting the second end of link member 30 with a first end of link member 33;
- a pivot 34 pivotally interconnecting the second end of link member 31 with a first end of link member 35;
- a pivot 36 pivotally interconnecting the rear end of innermost telescoping tube 21 with intermediate portions of link members 33 and 35;
- a pivot 37 pivotally interconnecting the second end of link member 35 with a first end of link member 38;
- a pivot 39 pivotally interconnecting the second end of link member 33 with a first end of link member 40;
- a pivot 41 pivotally interconnecting the rear end of outermost tube 11 with the second ends of link members 38 and 40;
- a pivot 42 pivotally interconnecting a first end of link member 43 with an intermediate point of link member 38;
- a pivot 45 pivotally interconnecting a first end of link member 44 with an intermediate point of link members 41; and
- a pivot 46 pivotally interconnecting the second end of link member 43, the second end of link member 44, and one end of an arm 47 of the actuator mechanim 8.

The seat support frame 17 is U-shaped and comprises two branches with respective free end members 48 and 49. End members 48 and 49 include respective holes 50 and 51 in which the rod 12 is rotatably mounted. As indicated in the foregoing description, the rod 12 is also free to rotate in holes 15 and 16 of the L-shaped brackets 13 and 14.

As illustrated in FIG. 1, a lever 52 is mounted to one end of the rod 12, perpendicular to this rod 12.

An arm 53 has a proximal end formed with a hole 54 in which the rod 12 is inserted. A set screw 55 secures the proximal end of the arm 53 to the rod 12. The arm 47 is formed of two parallel bars. The distal end of the arm 53 extends between the two bars of the arm 47 and is pivotally connected to first ends of these bars through a horizontal and transversal pivot 55. A pivot member 56, including pivot 46 extends between the two bars of the arm 47 and is pivotally connected to the second ends of these bars through a horizontal and transversal pivot 57.

FIGS. 5 and 6 present a partial cross-sectional view of the footrest assembly 2 in retracted (FIG. 5) and extended (FIG. 6) positions, showing the assembly inside the tubes 11, 20 and 21.

First and second guides 58 and 59 are mounted on the upper and lower faces of the proximal end of the inner telescoping tube 21. Similarly, a third guide 60 is mounted on the inner face of the top wall of the outer tube 11. As can be seen, guides 58 and 59 are longitudinally spaced apart from guide 60. According to the illustrative embodiment, the guides 58, 59 and 60 are made of low friction material, for example nylon, Teflon™, etc., to minimise wear, noise, as well as the force required to impart a sliding movement to the tubes 11, 20 and 21 relative to each other.

The operation of the low profile articulated footrest assembly 2 will now be described.

Referring to FIGS. 1, 3, 4, 5 and 6, starting with the footrest assembly 2 in retracted position, pulling lever 52 in direction 63 (FIG. 1) will impart a rotation to rod 12 in direction 64 (FIG. 1). Rotation of rod 12 in direction 64 will in turn produce the following sequence of events:

- Rotation of rod 12 imparts rotation of arm 53 in direction 64 about the longitudinal axis of rod 12;
- Rotation of arm 53 in direction 64 will move the arm 47 forwardly in direction 65 (FIG. 4);
- Forward movement of arm 47 will push pivot 46 in direction 65 through the pivot member 56;
- Forward movement of pivot 46 will pull the arms 38 and 40 through the arms 43 and 44 and the pivots 42 and 45;
- The arms 38 and 40 will pivot about pivot 41 to move the pivots 37 and 39 toward each other and to move pivot 36 forwardly in direction 65; and
- The arms 33 and 35 will rotate about pivot 36 to move pivots 32 and 34 toward each other and to move the pivot 29 forwardly in direction 65 through the arms 30 and 31.

Those of ordinary skill in the art will appreciate that the different lengths of the link members 43, 44, 38, 40, 33, 35, 30 and 31 and the respective positions of the pivots 46, 41, 42, 45, 37, 39, 36, 32, 34 and 29 are so designed that a short displacement of pivot 46 in direction 65 will produce a relatively large displacement of pivot 36, connected to the inner tube 21, in the same direction and an even larger displacement of pivot 29, connected to the intermediate tube 20, in that direction 65.

Figure 2:
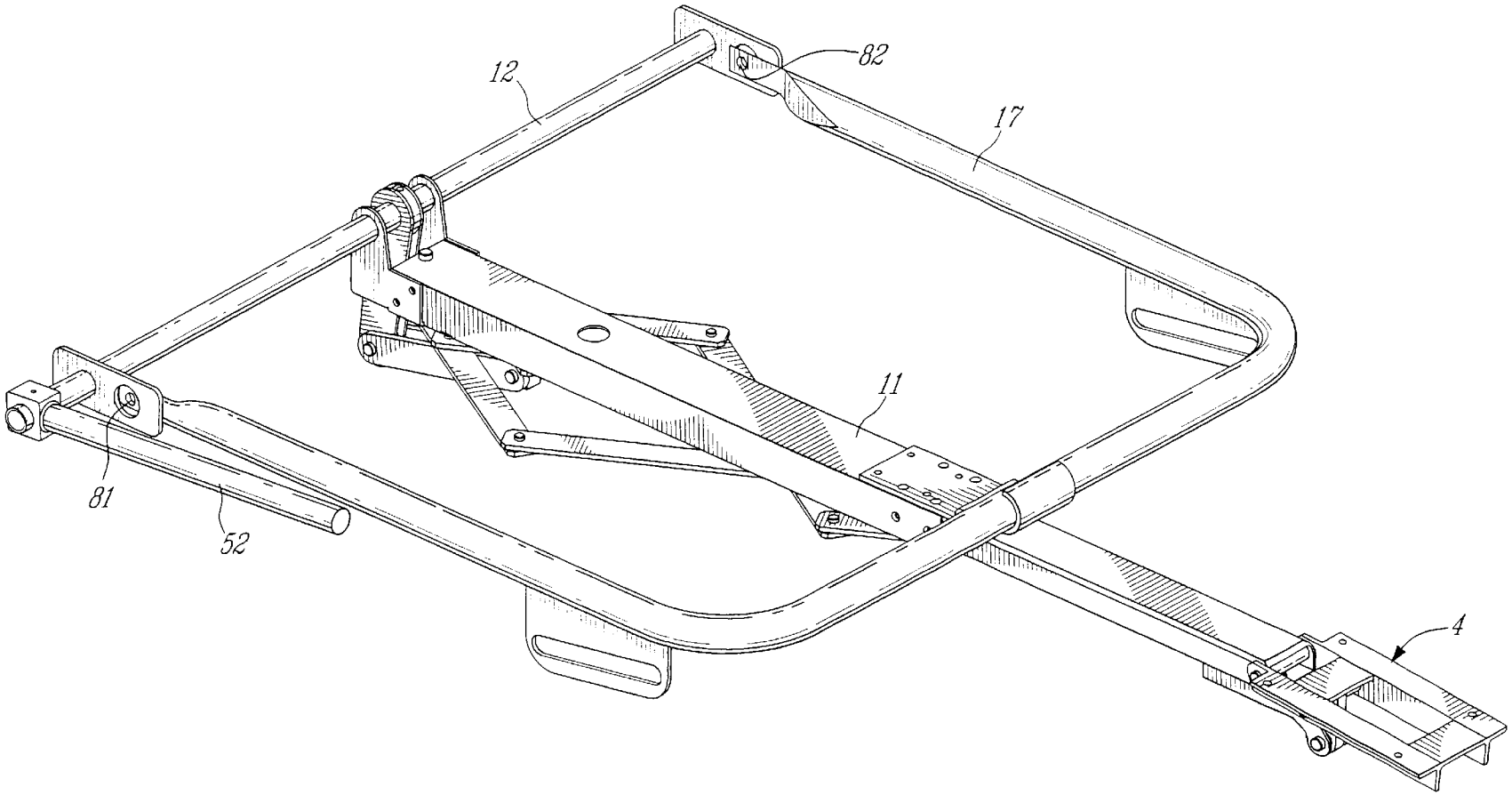
FIG. 2 is a front, top perspective view of the articulated footrest assembly of FIG. 1, in the extended position.

Forward displacement of the intermediate 20 and inner 21 tubes will move the footrest member 4 forwardly. Since the forward displacement of the intermediate tube 20 is larger than the forward displacement of the inner tube 21, this difference in displacement will rotate through the pivots 22 and 25 the footrest member 4 from a substantially vertical position as shown in FIG. 1 to a substantially horizontal position as shown in FIG. 2.

Obviously, operation of the lever in the direction opposite to direction 63 will return the footrest assembly 2 in the retracted position.

Therefore, one can contemplate that the low profile articulated footrest assembly 2 according to the present invention, amongst other features, is compact, can be installed in a very limited space, is easy to operate by a seat occupant, and provides a comfortable footrest once a cushioned footrest plate (not shown) is assembled to the footrest member 4.

Figure 8:
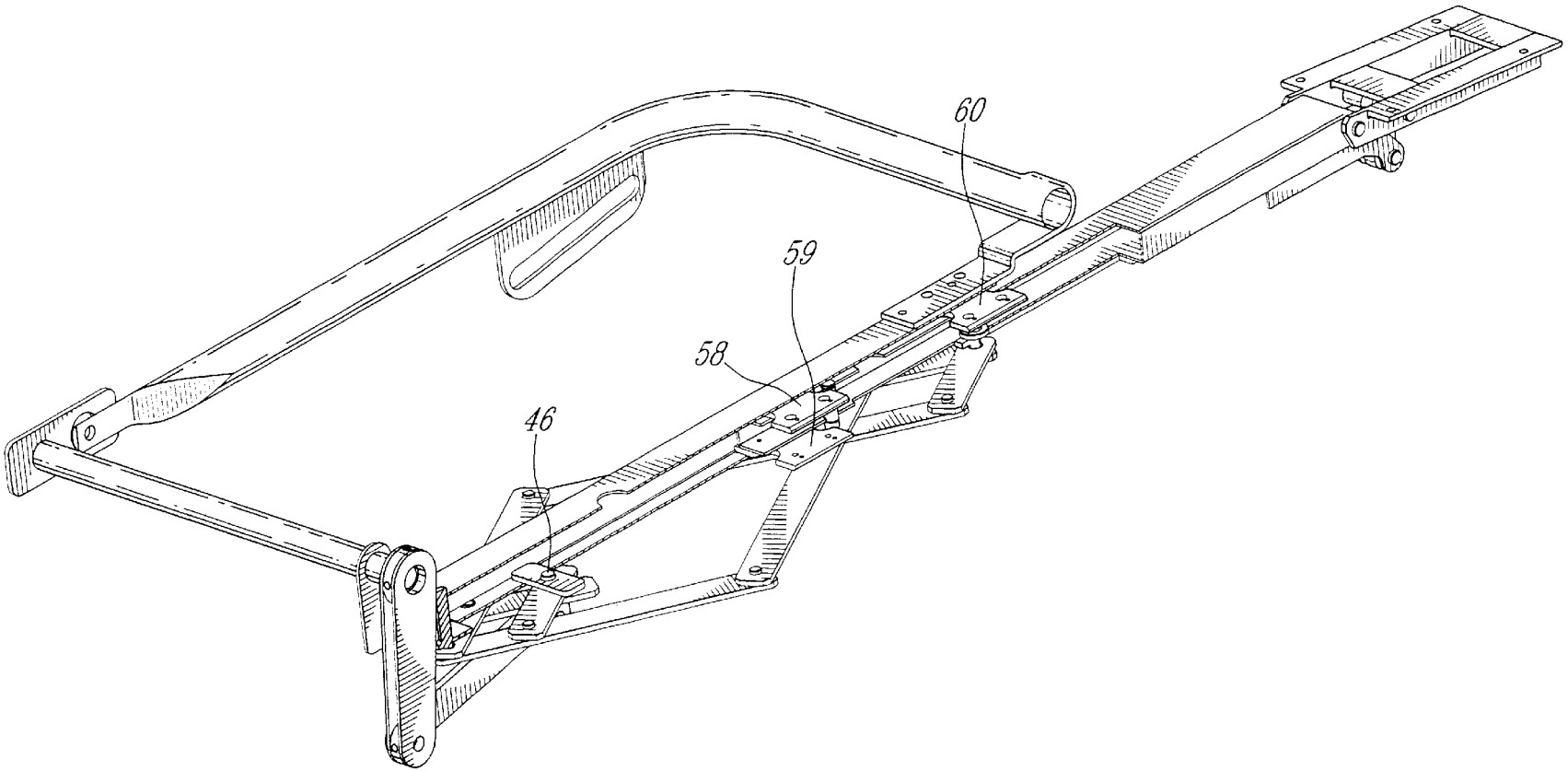
FIG. 8 is a side elevational view of the rocking armchair of FIG. 7, with the articulated footrest assembly in the extended position.
Figure 7:
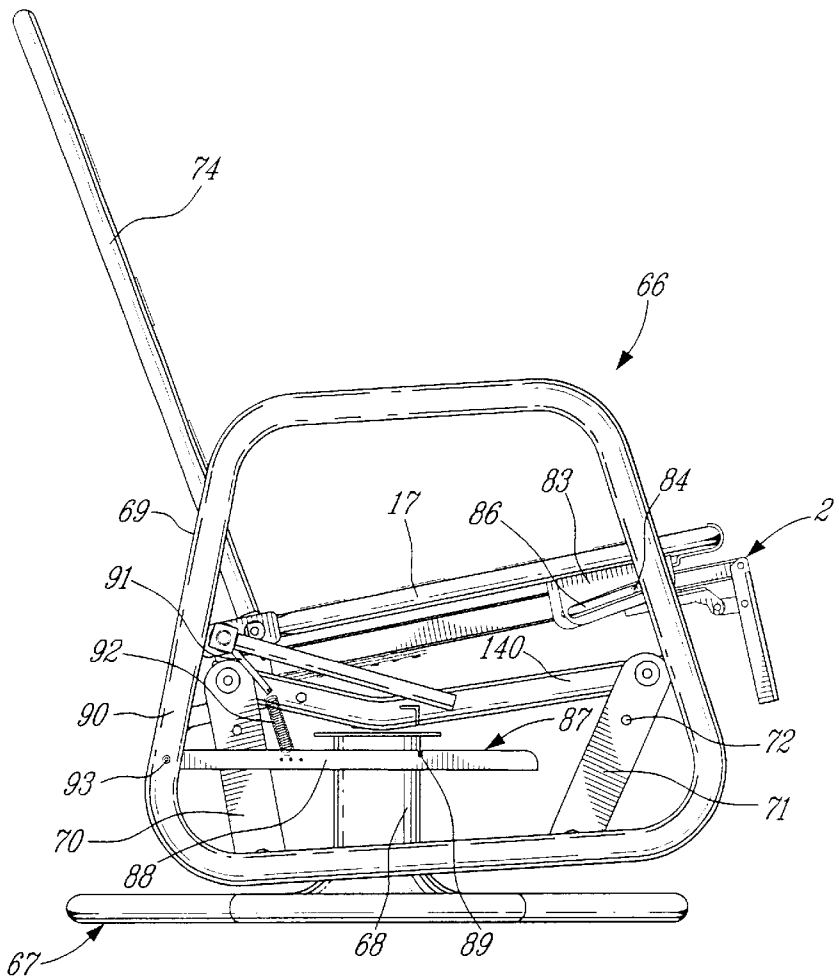
FIG. 7 is a side elevational view of the illustrative embodiment of rocking armchair according to the present invention, incorporating an articulated footrest assembly in the retracted position, and a glide motion preventing lock device.
Figure 8:
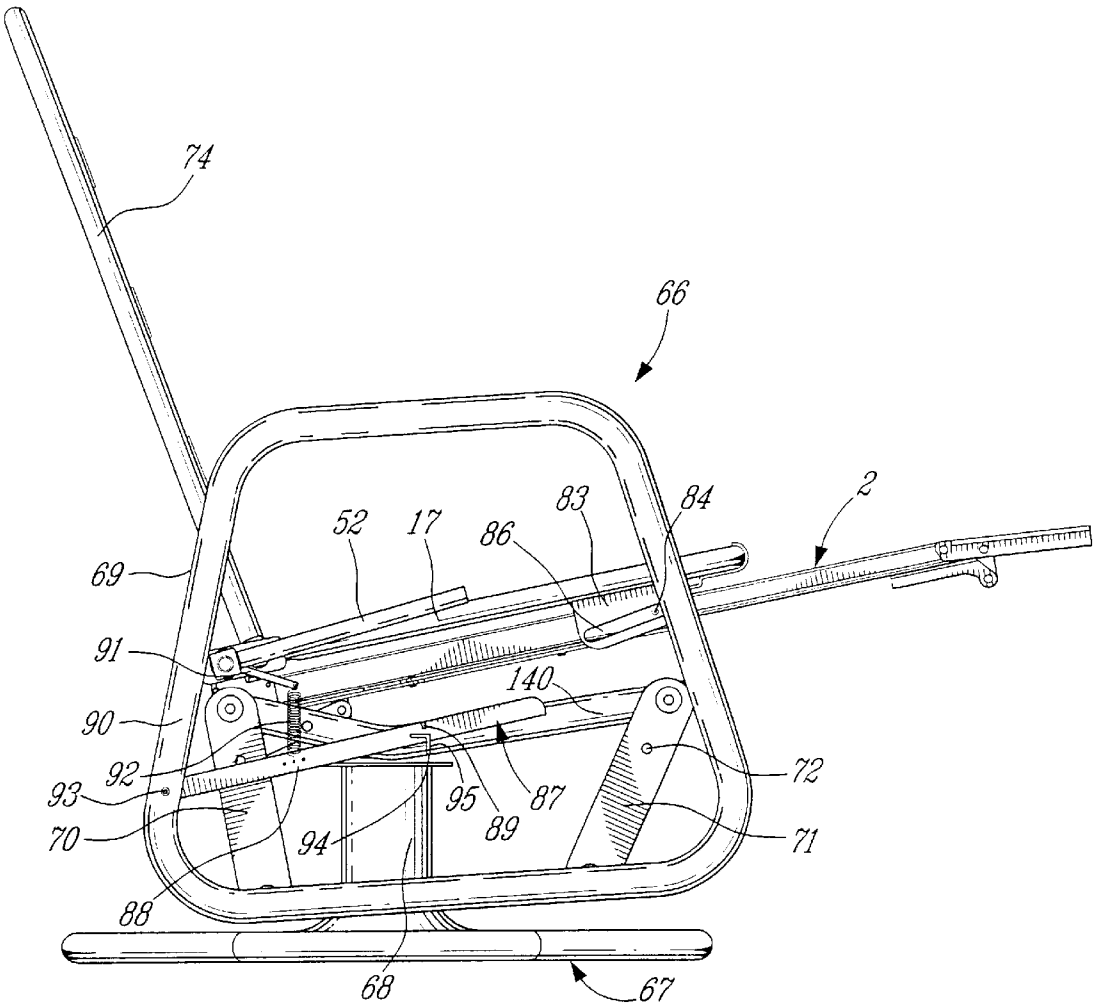
Figure 9:
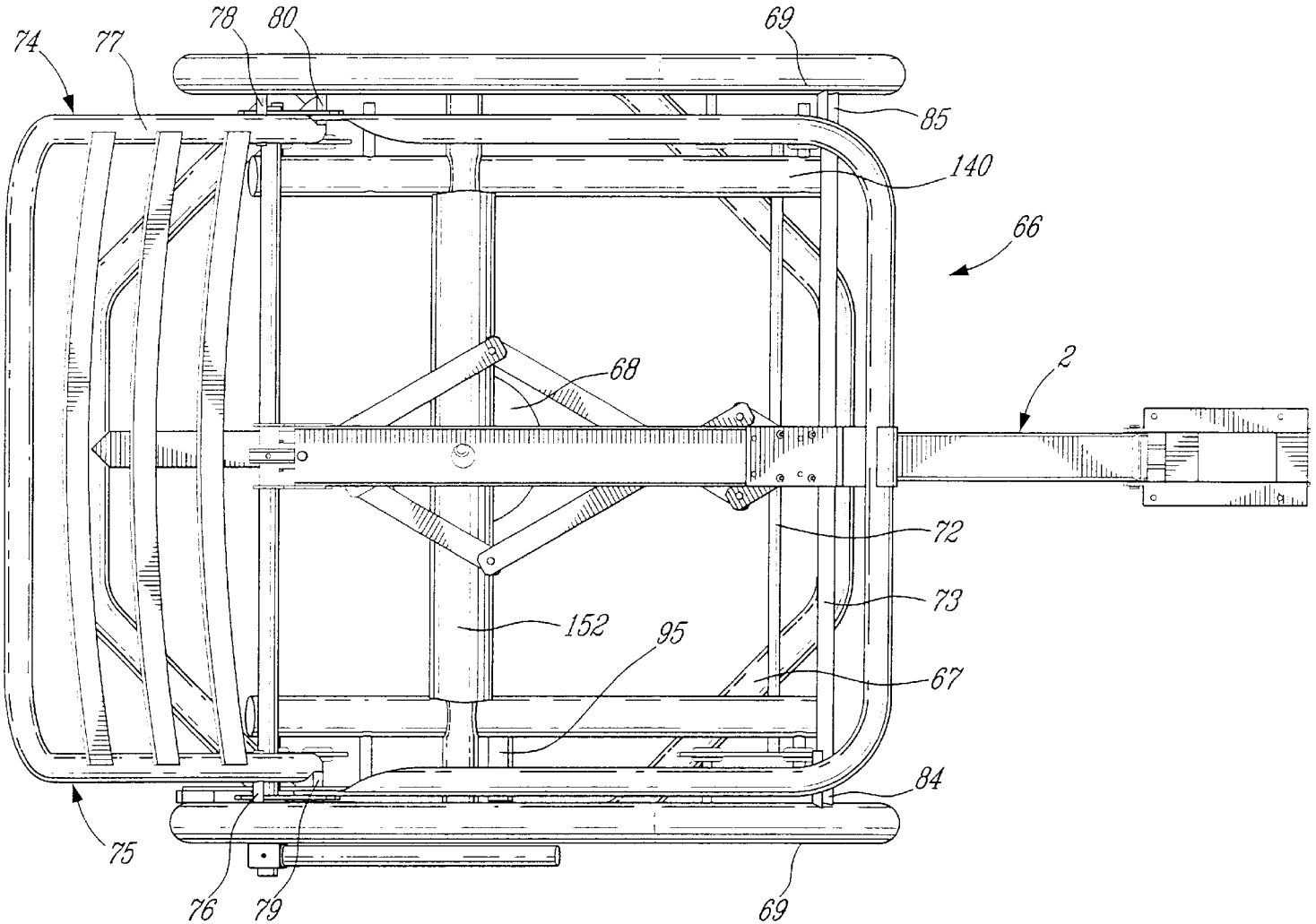
FIG. 9 is a top plan view of the rocking armchair of FIGS. 7 and 8.

Referring now to FIGS. 7, 8 and 9, a gliding seating assembly, more specifically a reclining and pivoting rocking armchair 66, using the low profile retractable footrest assembly 2 as described hereinabove, will now be described. FIG. 6 is a side elevational view of the armchair 66 with the footrest assembly 2 in retracted position, FIG. 7 is a side elevational view of the armchair 66 with the footrest assembly 2 in extended position, and FIG. 9 is a top plan view of the armchair 66 with the footrest assembly 2 in extended position. FIGS. 7, 8 and 9 illustrates, in particular, an integrated glide motion preventing lock device of the armchair 66.

The rocking armchair 66 of FIGS. 7–9 is illustrated without the cushions, and comprises a floor supported chassis 67 comprising a central pedestal 68, a generally H-shaped (when viewed from top) base crown 140 pivotally mounted on top of the central pedestal 68, a frame 69 suspended from the H-shaped base crown 140 by means of a pair of pivotally assembled symmetrical rear glide links such as 70 and front glide links such as 71, the seat support frame 17, and the low profile articulated footrest assembly 2 assembled as described hereinabove to the seat support frame 17. Since the structure and operation of the low profile articulated footrest assembly 2 has been fully described in the foregoing description, it will not be further elaborated herein. The suspended frame 69 to which the seat support frame 17 is connected is free to glide forwards and backwards and can be freely and infinitely rotated in any direction with respect to the floor supported chassis 67. The floor supported chassis 67, as illustrated, preferably has an octagonal perimeter to contact a supporting surface while providing optimal clearance and stability (see FIG. 9).

The low profile articulated footrest assembly 2 is fitted within a small portion of the space underneath the seat support frame 17 which, in the illustrative embodiment, is of the order of two inches. Referring to FIGS. 7, 8 and 9, this allows the footrest assembly 2 to clear a cross-member 72 of the front glide linkage 71, a second cross-member 73 of the suspended frame 69 and a third cross-member 152 of the H-shaped pivoting crown 140, pivoting about a generally vertical axis.

The rocking armchair 66 further comprises a reclining backrest 74 pivotally assembled to the seat support frame 17 and the suspended frame 69. A right side member 75 of the backrest 74 is assembled to a right portion of the suspended frame 69 by means of a pivot 76. A left side member 77 of the backrest 74 is assembled to a left portion of the suspended frame 69 by means of a pivot 78 (FIG. 9). The lower end of each of said backrest side members 75 and 77 is pivotally assembled to the rear portion of the two branches of the seat support frame 17 by means of two respective pivots 79 and 80, thus providing a two point rear articulated connection of the seat support frame 17 to the suspended frame 69. Just a word to mention that the pivots 79 and 80 are mounted in the holes 81 and 82 (FIG. 1) in the rear portion of the two branches of the U-shaped seat support frame 17. The seat support frame 17 is further provided with right and left slotted flanges such as 83 (FIGS. 7 and 8) for articulated connection to the front end of the suspended frame 69, through a pivot (see 84 and 85) inserted in each slot such as 86 of each flange such as 83. Therefore, seat support frame 17 and backrest 74 form a seat assembly connected to the suspended frame 69 through four articulated points such that the relative angular position of the backrest with respect to the seat can be varied at will by an occupant. When a desired angular position is reached, a lock device (not shown) can be activated to lock the seat assembly in the chosen position, independently from the gliding motion of the armchair and from the articulation of the footrest assembly 2.

Referring to FIGS. 7 and 8, in order to prevent an occupant from experiencing uncomfortable feelings and being subjected to unsafe situations due to sudden changes in the position of the centre of gravity of the rocking armchair 66, a rocking motion preventing lock device 87 is further provided to simultaneously and automatically prevent the gliding motion of the rocking armchair when the low profile articulated footrest assembly 2 is extended. The lock device 87 comprises a notched lock arm 88, comprising at least one upper notch such as 89. One end of the lock arm 88 is pivotally mounted to a rear member 90 of the suspended frame 69 through a pivot 93. Connected to the lever 52 is a coplanar small arm 91. Between the free end of the small arm 91 and an intermediate point of the lock arm 88 is mounted an helical spring 92.

In the position of FIG. 7, the footrest assembly 2 is retracted and the arm 91 and spring 92 place the lock arm 88 in a position in which the notch 89 is free to thereby enable the gliding motion of the armchair 66.

In the position of FIG. 8, the footrest assembly 2 is extended and the arm 91 and spring 92 pull the lock arm 88 to rotate it about pivot 93 until the notch 89 engages an edge 94 of an angle bar 95 to prevent the gliding motion of the armchair 66. For that purpose, the angle bar 95 is secure to the H-shaped crown 140 (see FIG. 9).

It can thus be seen that by pulling the lever 52 upwardly in direction 63 (FIG. 1) to extend the footrest assembly 2, the small arm 91 and spring 92 simultaneously rotate the lock arm 88 to engage the notch 89 in the edge 94 of angle bar 95. The suspended frame 69 and crown 140 are then locked to each other so that any gliding movement is prevented until lever 52 is operated again in the direction opposite to direction 63 to retract the footrest assembly 2, thus returning all the elements of the lock device 87 to their original non-activated position.

It will be apparent to one of ordinary skill in the art that the above described illustrative embodiment of the present invention provide effective and practical solutions for the installation of an articulated footrest assembly on a broad range of seating units with unmatched functional and economic performance.

Therefore, it can be seen that the low profile articulated footrest assembly according to the present invention can be advantageously used in miscellaneous applications, including retrofit to existing seating units and implementation into a specific and innovative reclining rocking armchair application, with numerous advantages over the solutions of the prior art.

Although the present invention has been described by means of an illustrative embodiment thereof, it is contemplated that various modifications may be made thereto without departing from the spirit and scope of the present invention. Accordingly, it is intended that the embodiment described be considered only as illustrative of the present invention and that the scope thereof should not be limited thereto but be determined by reference to the claims hereinafter provided and their equivalents.

What is claimed is:

1. An articulated footrest assembly for a seating unit, comprising:

a footrest member moveable between a retracted position and an extended position, and comprising proximal and distal portions;

a telescopic linkage for extending and retracting the footrest member between the retracted and extended positions, the telescopic linkage comprising a stationary support member mounted to the seating unit, a first telescoping arm, and a second telescoping arm, wherein the first telescoping arm has a distal end connected to the proximal portion of the footrest member through a first pivot, and wherein the second telescoping arm has a distal end connected to the footrest member between the proximal and distal portions through a second pivot spaced apart from the first pivot; and an actuating linkage comprising a first linkage portion interposed between the stationary support member and the first telescoping arm and a second linkage portion interposed between the first and second telescoping arms wherein, when the actuating linkage is operated, the first linkage portion moves the first telescoping arm in one of forward and rearward directions relative to the stationary support member and the second linkage portion moves the second telescoping arm in said one direction relative to the first telescoping arm thereby simultaneously moving the footrest member in said one direction and pivoting said footrest member about the first and second pivots.

2. An articulated footrest assembly as defined in claim 1, wherein the stationary support member is mounted underneath a seat of the seating unit.

3. An articulated footrest assembly as defined in claim 1, wherein the first linkage portion has a first stroke, the second actuating linkage has a second stroke, and the second stroke is shorter than the first stroke.

4. An articulated footrest assembly as defined in claim 1, wherein the actuating linkage comprises a series of first, second and third link means pivotally connected to each other and pivotally connected to the stationary support member, the first telescoping arm, and the second telescoping arm through respective pivots.

5. An articulated footrest assembly as defined in claim 4, wherein the actuating linkage comprises a pantograph formed by said first, second and third link means.

6. An articulated footrest assembly as defined in claim 5, wherein:

the first link means comprises first and second link members having respective first ends, and respective second ends, said first ends being pivotally connected to each other and to the stationary support member;

the second link means comprises third and fourth links having respective third ends, intermediate portions and respective fourth ends, the third ends being pivotally connected to the second ends, respectively, and the intermediate portions being pivotally connected to each other and to the first telescoping arm; and the third link means comprises fifth and sixth links having respective fifth ends and respective sixth ends, the fifth ends being pivotally connected to the fourth ends, respectively, and the sixth ends being pivotally connected to each other and to the second telescoping arm.

7. An articulated footrest assembly as defined in claim 1, wherein the telescopic linkage comprises three telescopically mounted elongated members forming the stationary support member, the first telescoping arm and the second telescoping arm, respectively.

8. An articulated footrest assembly as defined in claim 1, further comprising an actuator mechanism connected to the actuating linkage, for operating said actuating linkage.

9. An articulated footrest assembly as defined in claim 8, wherein the actuator mechanism is a manual actuator mechanism.

10. A reclining rocking chair comprising:

a floor supported chassis carrying a seat support frame having a free space thereunder and a backrest;

an articulated footrest assembly, including:

a footrest member moveable between a retracted position and an extended position, and comprising proximal and distal portions;

a telescopic linkage for extending and retracting the footrest member between the retracted and extended positions, the telescopic linkage comprising a stationary support member mounted to the seat support frame, a first telescoping arm, and a second telescoping arm, wherein the first telescoping arm has a distal end connected to the proximal portion of the footrest member through a first pivot, and wherein the second telescoping arm has a distal end connected to the footrest member between the proximal and distal portions through a second pivot spaced apart from the first pivot; and an actuating linkage comprising a first linkage portion interposed between the stationary support member and the first telescoping arm and a second linkage portion interposed between the first and second telescoping arms wherein, when the actuating linkage is operated, the first linkage portion moves the first telescoping arm in one of forward and rearward directions relative to the stationary support member and the second linkage portion moves the second telescoping arm in said one direction relative to the first telescoping arm thereby simultaneously moving the footrest member in said one direction and pivoting said footrest member about the first and second pivots; and a reclining backrest pivotally mounted to the seat support frame.

11. A reclining rocking chair as recited in claim 10, further comprising a rocking motion preventing lock engaged when the footrest member is in the extended position.

12. A reclining rocking chair as recited in claim 11, further comprising a rocking frame suspended from the floor supported chassis, wherein the rocking motion preventing lock comprises an arm pivotally connected to the rocking frame and comprising a notch, and a notch engaging member mounted on said floor supporting chassis for engaging said notch.

13. A reclining rocking chair as recited in claim 12, further comprising an actuator mechanism connected to the actuating linkage, for operating said actuating linkage, said actuator mechanism being also connected to the arm of the rocking motion preventing lock to operate said arm of the rocking motion preventing lock simultaneously with said actuating linkage.

* * * * *